US010154724B2

(12) United States Patent
Boino et al.

(10) Patent No.: US 10,154,724 B2
(45) Date of Patent: Dec. 18, 2018

(54) PERSONAL OBJECT CARRIER

(76) Inventors: Jacqueline Boino, Dalton, MA (US); Kalee Carmel, Pittsfield, MA (US)

( * ) Notice: Subject to any disclaimer, the term of this patent is extended or adjusted under 35 U.S.C. 154(b) by 407 days.

(21) Appl. No.: 12/542,052

(22) Filed: Aug. 17, 2009

(65) Prior Publication Data

US 2011/0036877 A1 Feb. 17, 2011

(51) Int. Cl.
*A45F 3/08* (2006.01)
*A45F 5/00* (2006.01)
*A45F 3/14* (2006.01)

(52) U.S. Cl.
CPC ..... *A45F 5/00* (2013.01); *A45F 2003/146* (2013.01); *A45F 2200/0583* (2013.01)

(58) Field of Classification Search
CPC ..... A45F 2003/045; A45F 3/14; A45F 2003/142; A45C 2200/20
USPC ..... 224/262, 148.4, 257, 254, 638, 623
See application file for complete search history.

(56) References Cited

U.S. PATENT DOCUMENTS 1,723,731 A * 8/1929 Hafling ..... A61J 9/08 215/11.1
2,182,164 A * 12/1939 Rosenberg ..... 248/104
2,677,488 A * 5/1954 Prusan ..... 119/770
3,901,579 A * 8/1975 Demerest ..... 359/519
4,328,533 A * 5/1982 Paredes ..... 362/108
4,564,957 A * 1/1986 Scharf ..... A41B 13/00 2/49.2
5,016,797 A * 5/1991 Rowledge ..... 224/257
5,319,806 A * 6/1994 Hermann et al. ..... 2/461
D373,677 S * 9/1996 Kelly ..... D3/229
6,095,657 A * 8/2000 Kent ..... 362/108
6,790,201 B2 * 9/2004 Meyer ..... 604/345
6,923,357 B2 * 8/2005 Smith ..... A01K 97/06 224/251
7,344,308 B2 * 3/2008 Meyer ..... A63B 57/60 383/41
2005/0072818 A1 * 4/2005 Howard ..... 224/148.5
2006/0255214 A1 * 11/2006 Simone ..... 248/102
2008/0287770 A1 * 11/2008 Kurzweil et al. ..... 600/388
2009/0242598 A1 * 10/2009 Dormaar ..... 224/257
2011/0214212 A1 * 9/2011 Marx ..... A41D 13/0007 2/2.5

* cited by examiner

*Primary Examiner* — Nathan J Newhouse
*Assistant Examiner* — Matthew Theis
(74) *Attorney, Agent, or Firm* — Fish & Richardson P.C.

(57) ABSTRACT

A personal object carrier apparatus includes a harness with a platform mounted to the harness and configured to support an object upon a ventral surface of a body surface of a user. The apparatus further includes a connector mounting the platform to the harness and configured for adjustment and securement of the platform at a desired height along the ventral body surface of the user.

10 Claims, 5 Drawing Sheets

PERSONAL OBJECT CARRIER

TECHNICAL FIELD

The disclosure relates to apparatus for carrying personal objects.

BACKGROUND

Personal objects, such as bottles of water and other beverages, wallets, cellular telephones, iPods, PDAs, etc. are often carried by hand during exercise, such as walking or running. This keeps the objects easily available, but also occupies the person's hands. Other means for carrying these and other types of personal objects include waist and ankle clips, backpacks, fanny packs, and the like, which free the person's hands, but do not keep the personal objects easily accessible. In other situations, possible users may be limited in their ability to carry or access such personal articles.

SUMMARY

According to one aspect of the disclosure, a personal object carrier apparatus comprises a harness, a platform mounted to the harness and configured to support an object at a ventral surface of a body of a user, and a connector extending between the platform and the harness for adjustment and releasable securement of the platform at a desired height along the body of the user.

Preferred implementations of this aspect of the disclosure may include one or more the following additional features. The harness comprises a pair of generally vertical shoulder straps and a generally horizontal body strap. The connector is configured for vertical adjustment along the shoulder straps of the harness. The platform remains in a relatively fixed position relative to the harness in the absence of a predetermined force applied to the connector, and the connector is responsive to a force in excess of the predetermined force for adjusting movement along the shoulder straps. The connector comprises one or more buttons and the harness comprises one or more cooperating buttonholes, or the connector comprises one or more snaps and the harness comprises one or more corresponding cooperating snaps, or the connector and the harness comprise one or more cooperating hook-and-loop-type fasteners. The platform comprises a sleeve with a lip. The platform further comprises a drawstring, e.g. formed of elastic material, configured to tighten the lip about an object engaged in the sleeve. The platform comprises a washable cloth material and/or a gripping material and/or a reflective material. The harness comprises cooperating hook-and-loop-type fasteners positioned for adjustable fastening between the shoulder straps and at the body strap, and the body strap comprises cooperating hook-and-loop-type fasteners for adjustable attachment about a user's body.

According to another aspect of the disclosure, a method of use of a personal object carrier apparatus configured to support an object at a ventral body surface of a user comprises: donning the personal object carrier apparatus; adjusting the personal object carrier apparatus to provide an appropriately snug fit; adjusting the vertical height of the platform; and performing an activity while supporting the object in a hands-free manner.

Preferred implementations of this aspect of the disclosure may include one or more the following additional features. The method further comprises tightening a sleeve on the platform about the object. The method comprises applying a force in excess of a predetermined force to urge the connector along the shoulder strap until the platform is at an acceptable height along the body of the user. The object comprises a straw, and the acceptable height along the body of the user is a height at which the straw is accessible to the user's mouth. The personal object carrier apparatus comprises a harness including cooperating hook-and-loop-type fasteners and a body strap including cooperating hook-and-loop-type fasteners, and adjusting the personal object carrier apparatus comprises joining the cooperating hook-and-loop-type fasteners on the harness to the cooperating hook-and-loop-type fasteners on the body strap.

According to still another aspect of the disclosure, a personal object carrier apparatus comprises a connector configured to remain in fixed position along a strap absent application of a predetermined force to the connector, and configured to the moveable along the strap upon application of a force in excess of the predetermined force to urge the connector along the shoulder strap.

Inexpensive and lightweight personal object carriers are provided to carry moderately heavy objects, such a drink bottles, in a hands-free manner. Different people may have need for such a carrier, such toddlers learning to walk, the physically challenged and elderly, and athletes such as runners and cyclists. These different people have differing requirements for such a carrier. A single adjustable carrier that meets the needs of different types of people is provided.

The details of one or more embodiments of the invention are set forth in the accompanying drawings and the description below. Other features, objects, and advantages of the invention will be apparent from the description and drawings, and from the claims.

DESCRIPTION OF DRAWINGS

Like reference symbols in the various drawings indicate like elements.

DETAILED DESCRIPTION

Figure 1:
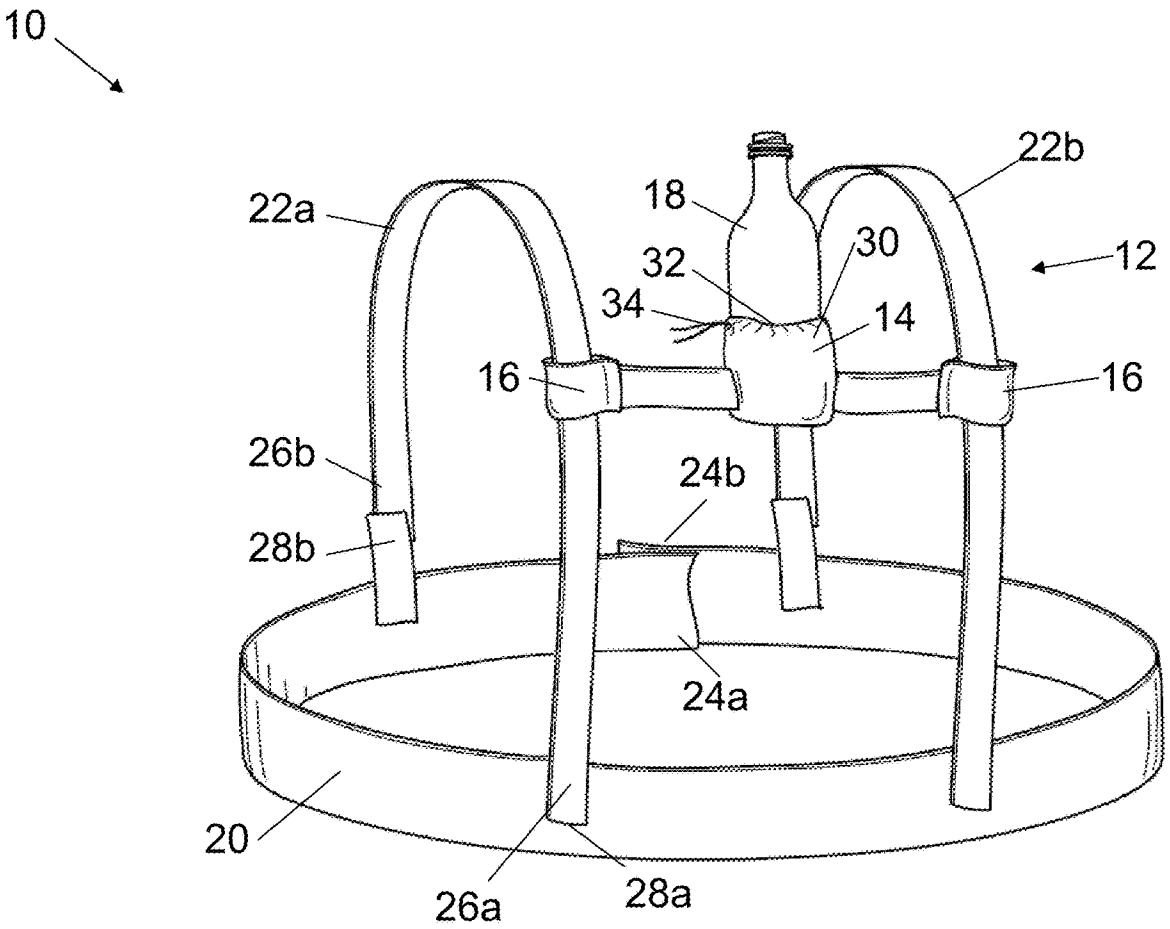
FIG. 1 is a perspective view of a personal object carrier apparatus of the disclosure.

FIG. 1 illustrates a personal object carrier apparatus 10 of the disclosure. Apparatus 10 includes a harness 12, a platform 14 configured to support an object 18 against a ventral (front) surface of a user's body 22, and a connector 16 extending between the platform and the harness and configured for adjustment and securement of the platform at a desired height along the user's body 22.

Figure 4:
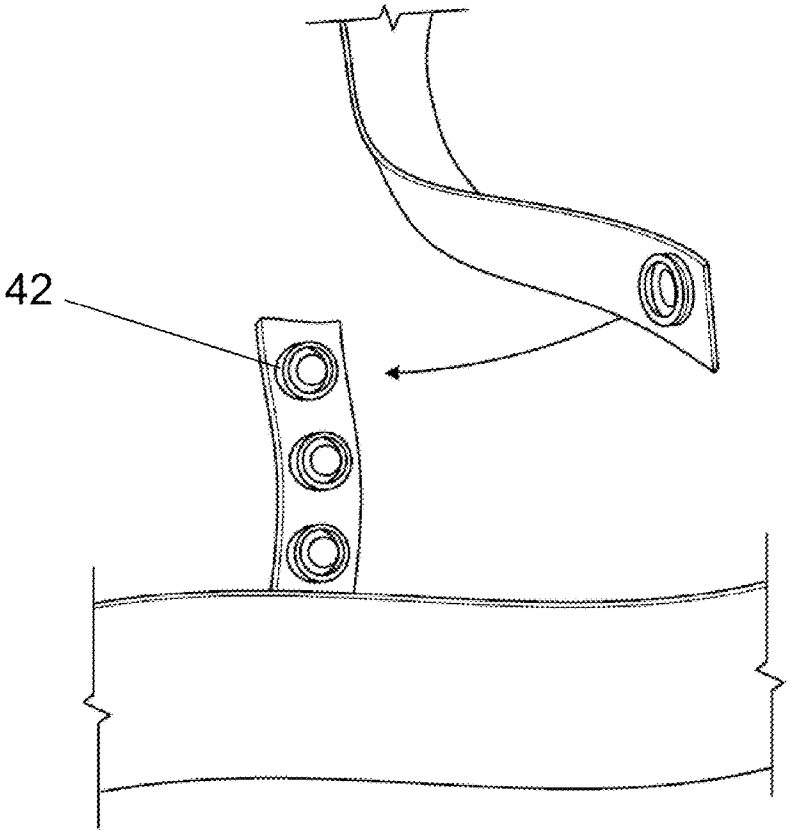
FIG. 4 is a perspective view of a fastener, e.g. cooperative snaps, of the apparatus of FIG. 1.
Figure 5:
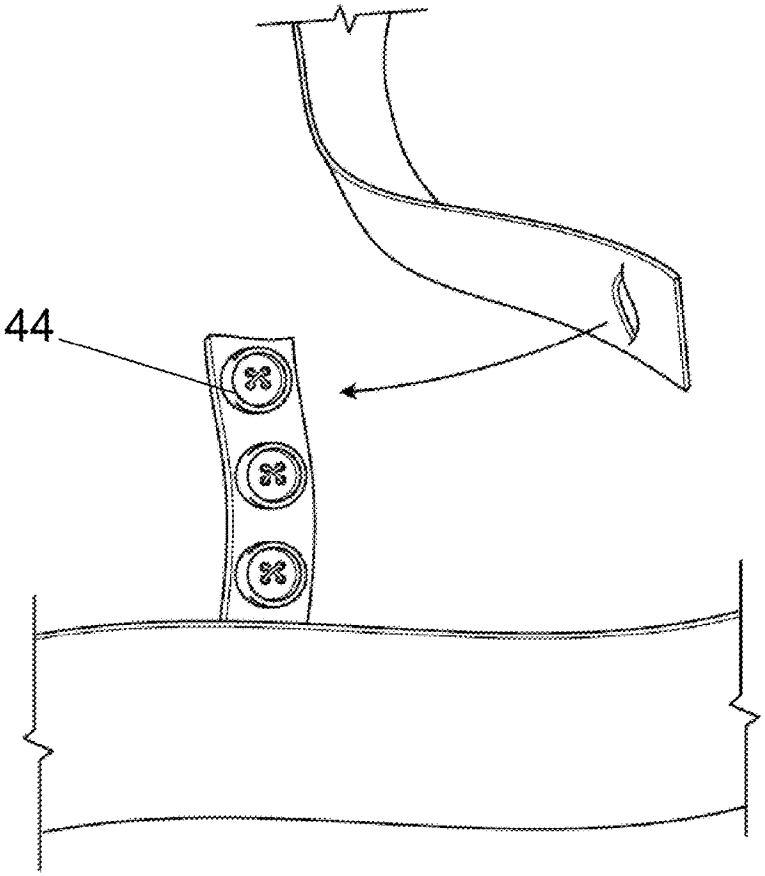
FIG. 5 is a perspective view of a fastener, e.g. cooperative buttons and buttonholes, of the apparatus of FIG. 1.

Harness 12 provides hands-free support for personal objects to be carried by the user, e.g. bottles of water and other beverages, wallets, cellular telephones, iPods, PDAs, etc. In the preferred embodiment, illustrated in FIG. 1, harness 12 includes a body strap 20 and shoulder straps 22*a* and 22*b*. Body strap 20 has fasteners 24*a* and 24*b* at each end. Fasteners 24*a* and 24*b* may be cooperating hook-and-loop-type fasteners, such as those manufactured by Velcro USA Inc., but can also be, for example, cooperating snaps 42 (FIG. 4) or cooperating buttons and buttonholes 44 (FIG. 5).

Multiple cooperating fasteners 24*b* are also provided at an end of body strap 20 to allow adjustment of the body strap 20 to fit a range of user body sizes. The user wraps body strap 20 around his or her body 22 and joins the opposed ends of the strap using fasteners 24*a* and 24*b* to secure the body strap snugly about the body 22. In a preferred embodiment, the fasteners 24*a* and 24*b* are joined at the back of the user's body, although they can also be joined, e.g., at the front of the body.

Body strap 20 is made from a suitable flexible material, such as polymer, fabric, leather, nylon, etc. Body strap 20 is preferably about 3 inches wide, although it can be less than 3 inches wide or greater than 3 inches wide.

Figure 3:
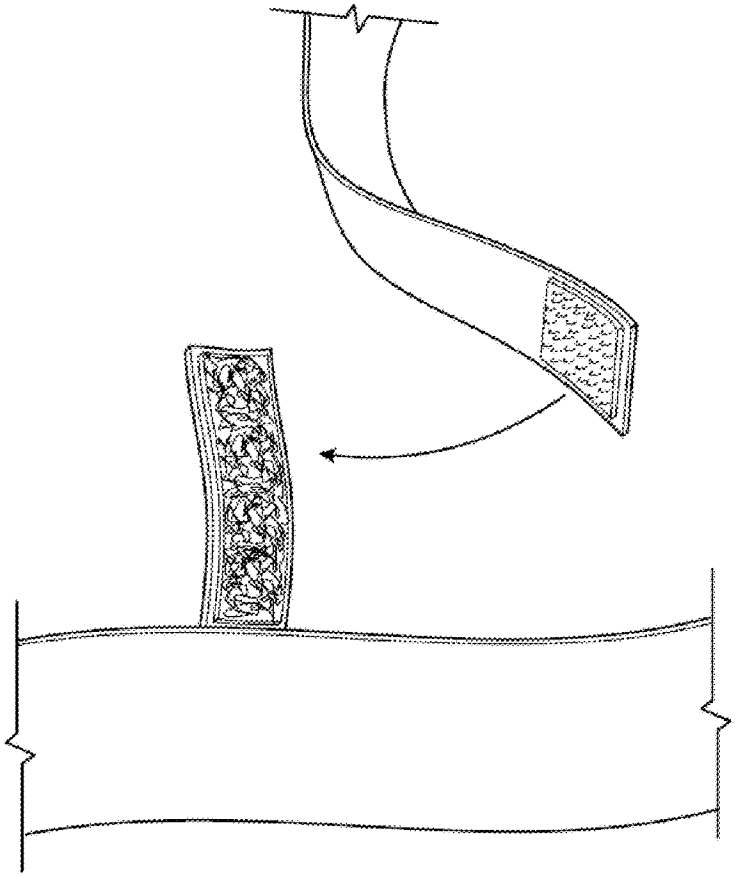
FIG. 3 is a perspective view of a fastener, e.g. cooperative hook-and-loop type fasteners, of the apparatus of FIG. 1.

Shoulder strap 22*a* has two ends, with a first fastener 26*a* at one of the ends to be fastened to a first cooperating fastener 28*a* on body strap 20, and a second fastener 26*b* to be fastened to a second cooperating fastener 28*b* on body strap 20. In the preferred embodiment, the first fastener 26*a* is permanently affixed to the first cooperating fastener 28, e.g. by sewing. The permanent fastening allows for a snug fit of the shoulder strap 22*a* to the user's body 22. In other embodiments, the first fastener 26*a* and first cooperating fastener 28*a* are, e.g., cooperative hook-and-loop-type fasteners. The second fastener 26*b* and second cooperating fastener 28*b* may be cooperative hook-and-loop-type fasteners, as illustrated in FIG. 3, but can also be, for example, snaps or buttons and corresponding buttonholes. Shoulder straps 22*a* and 22*b* are made from a suitable flexible material, such as polymer, fabric, leather, nylon, etc. It is preferable that shoulder straps 22*a* and 22*b* be made from a non-slippery material. Shoulder straps 22*a* and 22*b* are each preferably about one inch wide, but can be somewhat less than one inch wide or somewhat greater than one inch wide.

Platform 14 is made from a suitable flexible material. In the preferred embodiment, platform 14 is made from a washable fabric material. Alternatively, platform 14 can be made from nylon or felt. It has been found that felt offers an advantage of resistance to condensation that may result from objects containing a cold liquid. Platform 14 preferably has a diameter of about four inches, or somewhat larger than the diameter of a typical liquid bottle. However, platform 14 can be provided in a range of sizes, or may be made adjustable, depending upon the user and/or the objects for which the apparatus is particularly designed or suited, for example, smaller than four inches, e.g., for a runner holding a music player or a toddler holding small toys, or larger than four inches, e.g., for a toddler holding larger toys. Limits of platform diameter may be imposed by requirements for resistance to torques applied by the object about the axis of the connector 16.

Object 18 rests on or within platform 14. Platform 14 has the form of a sleeve 30 with a lip 32 to facilitate holding object 18 securely. Lip 32 is designed to grip object 18 circumferentially. Gripping may be accomplished, e.g., via a drawstring 34 pulled through ends of a channel in sleeve 30, configured to tighten the lip around the object. Alternatively, lip 32 may be made from, e.g., an adjustable gripping material, such as cooperating hook-and-loop-type fasteners, such as those manufactured by Velcro USA, or tacky or other suitable non-slippery material. Drawstring 34 may also, or instead, be made of an elastic material, and ribbons may also be used. Alternatively, platform 14 may be made, in its entirety, from a gripping material, such as hook-and-loop-type fasteners, such as those manufactured by Velcro USA., or an elastic, tacky, or non-slippery material, to better hold object 18.

In some applications, where the apparatus is to be used, for example, at night near a road, it is advantageous for the platform to be made from or includes a reflective material 36, such as Scotchlite™ manufactured by the 3M Corporation.

Platform 14, in the preferred embodiment, has the shape of a cylinder. Alternatively, platform 14 can be in the shape of a closed, convex polygon, e.g., a cube.

Connector 16, in the preferred embodiment, is configured for vertical adjustment along the shoulder straps of the harness. Platform 14 can be designed to remain in a relatively fixed position relative to the harness in the absence of a predetermined force applied to connector 16, and platform 14 is responsive to application to the connector of a force in excess of the predetermined force for adjusting movement along shoulder strap 22*a*. That is, connector 16 may stay fixed in place without use of a fastener. Such a configuration may be accomplished by sewing a loop, e.g., of elastic material, about the shoulder strap. The loop may be just large enough to allow movement of the connector with application of the predetermined force, but small enough to maintain the connector, and the platform, in fixed position in the absence of such a force. A non-slippery shoulder strap material is preferable for the connector so that the friction force required to keep connector 16 in place is sufficient. Alternatively, connector 16 may have buttons and harness 12 may have cooperating buttonholes on shoulder strap 22*a* to provide sufficient force to keep connector 16 in place. In another implementation, connector 16 may have snaps, and harness 12 may have corresponding cooperating snaps on shoulder strap 22*a*.

Figure 2:
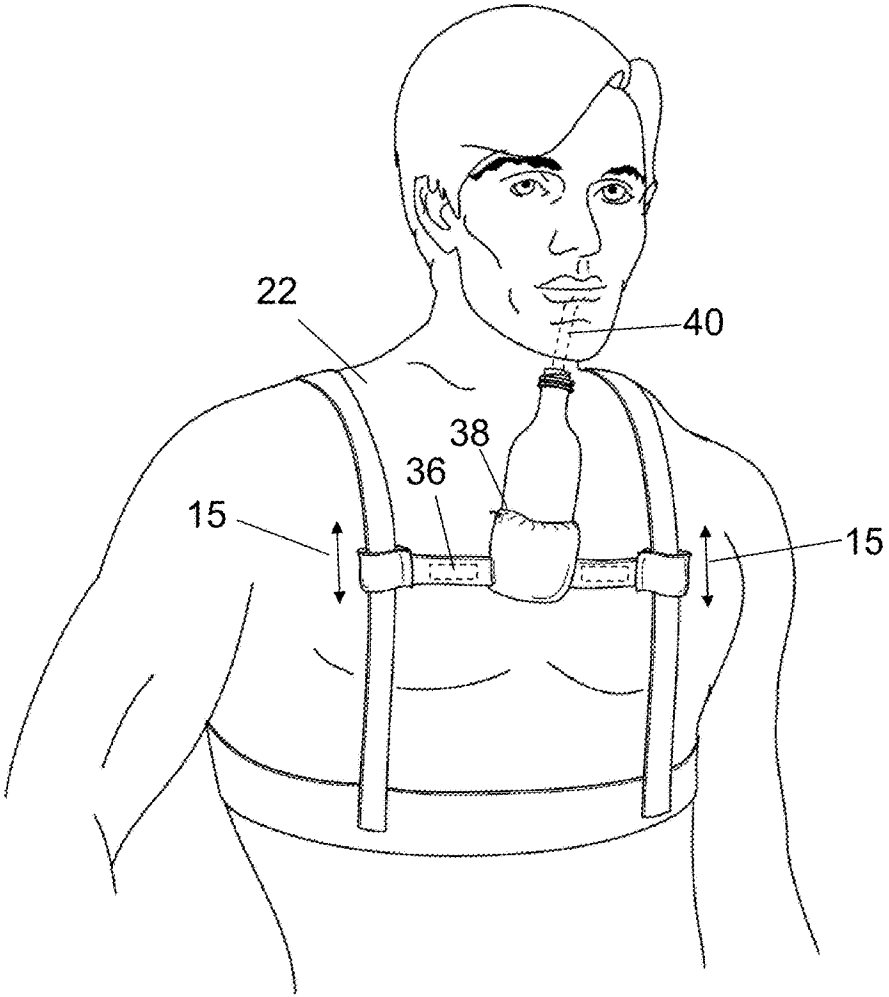
FIG. 2 is a perspective view of the personal object carrier apparatus of FIG. 1 adjustably mounted on a ventral surface of a body of a user.

A user dons the personal object carrying apparatus 10 on his or her body 22 as illustrated in FIG. 2. The user adjusts harness 12 to provide a snug fit. The user adjusts the platform 14 (arrows 15) to place the platform, and the carried object, at an acceptable height along the ventral surface of the user's body. The user then performs an activity while object 18 is supported in a hands-free manner.

In order to ensure the hands-free nature of the activity, sleeve 30 on platform 14 can be tightened around about object 18. This tightening can be accomplished, e.g., with drawstring 34 led through sleeve 30. Tightening in this fashion involves pulling drawstring 34 through sleeve 30 until lip 32 on sleeve 30 is taut around object 18. The user then secures the ends of drawstring 34 in a knot. Alternatively, the tightening can be accomplished using a closed elastic loop within sleeve 30.

The adjusting of the apparatus can be accomplished by joining hook-and-loop-type fasteners on the harness 12 to cooperating hook-and-loop-type fasteners on body strap 20. Preferably, there are three cooperating fasteners on body strap 20 corresponding to different sizes of users; however, two cooperating fasteners, or more than three cooperating fasteners may be used. Alternatively, the fasteners may be buttons or snaps as described previously.

Adjustment of the vertical height of the platform can be accomplished by applying a force in excess of a predetermined force to the connector, urging it along shoulder strap 22*a* until the platform is at an acceptable height for the user. The acceptable height along the user may depend, e.g., on the nature of object 18. For example, if object 18 is a bottle, e.g., a sports drink bottle, with a straw 40, an acceptable height along the user may be a height at which the straw is accessible by the user's mouth. Alternatively, object 18 may consist of one or more toys that fit within platform 14, and an acceptable height may be that which would place the toys accessible to the user's hands.

There are many applications for the apparatus of this disclosure corresponding to possible activities a user may wish to accomplish while wearing the apparatus, some of which are enumerated here, but only by way of example. The user may be, for example, a runner wishing to hold a sports bottle in a hands-free manner. Alternatively, the user may be a cyclist wishing to hold a sports bottle in a hands-free manner without needing to bend down to a bottle holder on a bicycle frame in order to drink. Alternatively, the user may be a toddler for whom having a drink bottle attached to his body would be an advantage so that, for example, the bottle would not get lost. Alternatively, the user may be an elderly and/or physically challenged individual for whom holding a drink bottle while walking is too difficult.

A number of embodiments of the invention have been described. Nevertheless, it will be understood that various modifications may be made without departing from the spirit and scope of the invention.

What is claimed is:

1. A personal object carrier apparatus comprising:

a harness comprising a pair of generally vertical shoulder straps and a generally horizontal body strap, wherein a first end of each shoulder strap is permanently affixed to the body strap at a front portion of the body strap and a second end of each shoulder strap includes a hook-and-loop-type fastener that is affixed to the body strap at a rear portion of the body strap by a respective cooperating fastener that extends orthogonally from the body strap, wherein each cooperating fastener is rectangular and includes a cooperating hook-and-loop-type fastener that is configured to attach to the hook-and-loop-type fastener at the second end of the respective shoulder strap, wherein cooperating elements of each fastener pair, extending orthogonally relative to the body strap and providing releasable engagement between the body strap and the respective shoulder strap, have a generally uniform width, a connector defining a connector axis and extending between, and mounted for vertical adjustment along, the generally vertical shoulder straps, and a platform comprising a circular base, a cylindrical sleeve, a lip, and a drawstring, the platform mounted to the connector and configured to support an upright object in the form of a drink container resting on the circular base of the platform and against a ventral surface of a body of a user at a desired height, such that the drink container, or a straw inserted in the drink container, is accessible by the user's mouth in a hands-free manner, wherein the drawstring is configured to tighten the lip about the drink container supported by the platform, wherein an opening defined by the platform faces upwards when the platform and the connector reside toward the front portion of the body strap, the platform made from a felt material that is configured to resist condensation created by a drink in the drink container, and the connector being configured to adjust a height of the connector and the platform vertically along the shoulder straps of the harness without needing to adjust a length of one or both of the shoulder straps.

2. The personal object carrier apparatus of claim 1, wherein the platform remains in a relatively fixed position relative to the harness in the absence of a predetermined force applied to the connector, and the connector is responsive to a force in excess of the predetermined force for adjusting movement along the shoulder straps.

3. The personal object carrier apparatus of claim 1, wherein the connector comprises one or more buttons, and the harness comprises one or more cooperating buttonholes.

4. The personal object carrier apparatus of claim 1, wherein the connector comprises one or more snap elements, and the harness comprises one or more corresponding cooperating snap elements.

5. The personal object carrier apparatus of claim 1, wherein the connector comprises one or more first hook-and-loop type fastener elements and the harness comprises one or more cooperating second hook-and-loop-type fastener elements.

6. The personal object carrier apparatus of claim 1, wherein the drawstring comprises elastic material.

7. The personal object carrier apparatus of claim 1, wherein the platform comprises a washable cloth material.

8. The personal object carrier apparatus of claim 1, wherein the platform comprises a reflective material.

9. The personal object carrier apparatus of claim 1, wherein the body strap comprises cooperating hook-and-loop-type fasteners for adjustable attachment about the user's body.

10. The personal object carrier apparatus of claim 1, wherein the drink container is a sports drink bottle.

* * * * *